US007461700B2

(12) United States Patent
Livingston, Jr. et al.

(10) Patent No.: US 7,461,700 B2
(45) Date of Patent: Dec. 9, 2008

(54) APPARATUS AND METHOD FOR A C-PLATE USED IN A CABLE GUIDED FISHING ASSEMBLY

(75) Inventors: Jimmy G. Livingston, Jr., Tomball, TX (US); Jay K. Motley, Katy, TX (US); Filiberto Garcia, Houston, TX (US); C. Steven Isaacks, Cypress, TX (US); Noe Tony Cordova, Houston, TX (US); James R. Streater, Jr., Humble, TX (US)

(73) Assignee: National Oilwell, L.P., Houston, TX (US)

( * ) Notice: Subject to any disclaimer, the term of this patent is extended or adjusted under 35 U.S.C. 154(b) by 314 days.

(21) Appl. No.: 11/218,157

(22) Filed: Sep. 1, 2005

(65) Prior Publication Data

US 2007/0044971 A1 Mar. 1, 2007

(51) Int. Cl.
*E21B 19/02* (2006.01)

(52) U.S. Cl. ..... 166/379; 166/75.11; 166/85.1; 166/75.14

(58) Field of Classification Search ..... 166/301, 166/85.1, 75.11, 243, 75.14, 379; 294/15, 294/102.2; 81/57.15, 57.16, 57.33, 57.34
See application file for complete search history.

(56) References Cited

U.S. PATENT DOCUMENTS 1,622,537 A * 3/1927 Neilson ..... 294/91
1,693,478 A * 11/1928 Davis ..... 294/90
1,795,578 A * 3/1931 Smith ..... 188/67
1,881,948 A 10/1932 Rayburn
2,916,305 A 12/1959 Sherman ..... 285/5
3,368,252 A * 2/1968 Meek, Sr. ..... 294/102.2
4,018,471 A * 4/1977 Shockey ..... 294/90
4,266,450 A * 5/1981 Farr et al. ..... 81/57.33
4,336,637 A * 6/1982 Patterson ..... 188/67
5,347,554 A 9/1994 White et al. ..... 376/260

(Continued)

OTHER PUBLICATIONS

Webster's Ninth New Collegiate Dictionary, 1985, Merriam-Webster Inc., p. 550.*

(Continued)

*Primary Examiner*—David J Bagnell
*Assistant Examiner*—Robert E Fuller
(74) *Attorney, Agent, or Firm*—Howrey LLP

(57) ABSTRACT

A C-plate assembly for use in a cable-guided fishing assembly is disclosed. The disclosed invention provides a C-plate assembly in which a closure member is slidable from an open position, which allows a wellbore tubular or other item to be positioned in the cut-out section of the C-plate base, to a closed position, which closes the opening to the cut-out section and thereby prevents the wellbore tubular or other item from being unintentionally knocked free from the cut-out section during a fishing operation. The closure member is locked in place in the closed position by inserting the ends of a movable handle extending off of one side of the C-plate base into openings in the C-plate base. The ends of the movable handle are spring loaded to allow for the ends to be pulled out of the openings in the C-plate base such that the closure member can be "unlocked" and moved from a closed position to an open position during operation.

48 Claims, 5 Drawing Sheets

U.S. PATENT DOCUMENTS

| | | | | |
|---|---|---|---|---|
| 5,477,921 | A | 12/1995 | Tollefsen | 166/250.13 |
| 5,661,771 | A | 8/1997 | Sridhar et al. | 376/313 |
| 5,779,333 | A | 7/1998 | Lautenschlager | 312/334.15 |
| 6,338,702 | B1 * | 1/2002 | Jordan | 482/108 |
| 6,350,078 | B1 | 2/2002 | Butkievich et al. | 403/290 |
| 2005/0199398 | A1 | 9/2005 | Cox | 166/301 |

OTHER PUBLICATIONS

Joe DeGeare, David Haughton, Mark McGurk, The Guide to Oilwell Fishing Operation.

Gulf Publishing Company, Oilwell Fishing Operations: Tools and Techniques, Aug. 1990.

Gunn Wireline, Wireline Tools.

National Oilwell, Cable Guided & Side Door Fishing Methods, 2004.

PCT International Search Report and Written Opinion, mailed Nov. 23, 2007, for corresponding PCT Serial No. PCT/US2006/033101, filed Aug. 23, 2006.

PCT International Preliminary Examination Report, mailed Sep. 26, 2008, for corresponding PCT Serial No. PCT/US2006/033101, filed Aug. 23, 2006.

* cited by examiner

APPARATUS AND METHOD FOR A C-PLATE USED IN A CABLE GUIDED FISHING ASSEMBLY

FIELD OF THE INVENTION

The present invention generally relates to equipment used for removing stuck downhole tools from an oil or gas well. In particular, the present invention relates to an improved C-plate assembly for use as part of a cable-guided fishing assembly used to remove downhole tools that have become stuck in a well.

BACKGROUND OF THE INVENTION

There are various methods of completion of and production from an oil or gas well. Typically, an oil or gas well is completed by cementing casing strings in place along substantially the entire depth of the well. Once the well is completed, production can commence. To facilitate the production of hydrocarbons or other fluids from the well, production tubing is typically installed within the cased wellbore. Production tubing is set in a portion of the well generally concentric with the casing. The production tubing allows communication of the producing zone of the well with the surface.

After the casing and production tubing are installed in the borehole, there is often need for various procedures to be performed on the well, such as perforating the well, well logging operations, and the like. These procedures are performed with tools that are typically attached to what is known as a wireline. The wireline is a metallic, braided cable with a plurality of electrical conductors contained therein, or is often just a metallic braided cable. The tools to be used for a given operation are lowered into the well on the end of the wireline and then activated or monitored at the surface by an operator. When operations with the tools are completed, the wireline and attached tool are pulled to the surface and removed from the well so that production can commence or resume, or so that further operations can be conducted in the well.

Occasionally, downhole tools become stuck in the well during the retrieval process. Downhole tools can become stuck in a well for various reasons, such as encountering a restriction that has formed in the inner diameter of the wellbore. Additionally, downhole tools sometimes become bridged over, or the line on which the tools are run becomes key-seated in the walls of the well bore, thereby hindering or preventing removal of the tools from the well. Often, these downhole tools are very expensive pieces of electronic instrumentation and/or have radioactive sources contained therein and, thus, they must be retrieved from the well. Moreover, these tools often present a hindrance to further operations in or production from the well and, thus, must be retrieved from the well. The procedure of retrieving a stuck tool is known as "fishing."

For situations in which the stuck tool is still attached to an intact wireline, either the cable-guided fishing method (also known as the "cut and strip" method) or the side-door overshot method is typically used to retrieve the tool. The cable-guided fishing method is typically used for deep, open-hole situations or when a radioactive instrument is stuck in the hole. For these situations, the cable-guided fishing method is a safe method that offers a high probability of success. In particular, the cable-guided fishing method allows retrieval of the stuck tool while the tool remains attached to the cable, thereby minimizing or removing the possibility that the tool will fall down the well during the fishing operation and allowing for the well bore to be cleared with a minimum of downtime. Further, in some instances, through use of the cable-guided fishing method, expensive multi-conductor cable can be salvaged.

The cable-guided fishing method is performed with a special set of tools (hereinafter referred to as the "fishing assembly"). The fishing assembly typically comprises a cable hanger with a T-bar, a spearhead rope socket, a rope socket, one or more sinker bars, a spearhead overshot, and a "C" plate. The fishing assembly may also comprise a swivel joint and a knuckle joint. To use the fishing assembly, the individual components of the assembly are assembled together in a series of steps. Specifically, a typical procedure for assembling the individual components of the fishing assembly is as follows (refer to FIG. 1 for a depiction of the individual components of the fishing assembly in their relative positions during and after assembly):

(1) a light pulling force is exerted on the wireline to remove any slack;

(2) a cable hanger (A) is attached to the wireline at the well head;

(3) the wireline is lowered until the cable hanger (A) rests on the well head or rotary table;

(4) the wireline is cut a short distance above the cable hanger (A);

(5) a spear head rope socket (B) is then "made up" to the end of the lower half of the severed wireline above the cable hanger (A);

(6) a rope socket (C) ("the upper rope socket") is made up to the end of the upper severed half of the wireline;

(7) one or more sinker bars (D) are connected to the upper rope socket (C);

(8) a spear head overshot (E) is connected to the lowermost sinker bar (D);

(9) the spear head overshot (E) is then engaged with the spear head rope socket (B), and a "test strain" is exerted on the assembly by "pulling" on the wireline to ensure that the components are properly connected;

(10) with the spear head overshot (E) engaged with the spear head rope socket (B), the wireline is then "pulled" to exert a force sufficient to raise the cable hanger (A) so that it can be removed from the assembly;

(11) after removing the cable hanger (A) from the assembly, a "C" plate (F) is placed under a specially-shaped section of the spear head rope socket (B);

(12) with the specially-shaped section of the spear head rope socket (B) resting on the "C" plate (F), the entire assembly can be lowered such that the "C" plate (F) rests on the well head or rotary table.

After assembling the individual components of the fishing assembly in this (or a similar) manner, the assembly can be used to "fish" the stuck tool out of the well.

In operation, the fishing assembly fishes the stuck tool out of the well in a series of steps. Specifically, the following steps are typical of the operation of the fishing assembly (refer to FIG. 2 for a depiction of the individual components of the fishing assembly in their relative positions during operation):

(1) the spear head overshot (E) is disconnected from the spear head rope socket (B) and raised up to the derrick man;

(2) the derrick man will then thread the spear head overshot (E) and sinker bar (D) through the first stand of pipe (G) to be run into the well as part of the fishing operation;

(3) the driller will then pick up the first stand of pipe (G) and suspend it over the well head;

(4) the spear head overshot (E) should then be connected to the spear head rope socket (B), a light strain taken on the cable, and the "C" Plate (F in FIG. 1) removed;

(5) the first stand of pipe (G) is then run in the well bore and slips (H) are set;

(6) the "C" Plate is then replaced, and the assembly is allowed to rest on the tool joint;

(7) the spear head overshot (E) is then disconnected and raised back up to the derrick man;

(8) the derrick man threads the spear head overshot (E) and sinker bar (D) through the next stand of pipe (I), which in turn is picked up by the driller and suspended over the well head through use of the rig's elevator (J);

(9) the spear head overshot (E) is connected to the spear head rope socket (B), the "C" Plate is removed, and the second stand of pipe (I) is stabbed into and made up to the first stand of pipe (G) and run into the well bore;

(10) the "C" Plate is replaced, the spear head overshot (E) is again disconnected and raised up to the derrick man, and the procedure is repeated until enough pipe has been run into the well to contact and free the stuck tool;

(11) after the fish has been contacted and pulled free, the cable hanger (A in FIG. 1) is again placed on the cable, the rope sockets (B, C) are removed from the cable, and the cable tied together;

(12) the elevator (J) is then latched around the "T" bar on the cable hanger, and a strain sufficient to pull the cable out of the tool is taken;

(13) the cable hanger is then removed, and the free cable is spooled on to a service truck reel;

(14) the fishing string along with the fish may then be pulled from the hole in the conventional manner.

While the fishing assembly and method of use described in the preceding paragraphs has proven to be quite successful, shortcomings with some of the components of the fishing assembly have been identified. For example, prior art C-plates include a "cut-out" section that extends from one edge of the C-plate to the center of the C-plate. This cut-out section is designed such that a section of the spear head rope socket and/or a portion of a wellbore tubular can be slid into the cut-out section such that the C-plate can support the tubular string in the hole during the fishing operation (as discussed above with reference to FIGS. 1 and 2). The prior art C-plates, however, do not contain any type of "cover" or "closure member" capable of closing the opening to the cut-out section during operation. As a result, it is possible to knock the spear head rope socket and/or portion of the wellbore tubular resting within the cut-out section out of the cut-out section, thereby potentially causing the tubular string that is supported by the C-plate to fall downhole. Given the amount of equipment and wellbore tubulars being moved about the rig floor during a fishing operation, this is a real possibility that has not been effectively addressed by prior art C-plates.

Accordingly, what is needed is a C-plate assembly that provides a movable cover or closure member that closes off the opening to the cut-out section of the C-plate such that the tubular member or other item positioned within the cut-out of the C-plate cannot be knocked free from the C-plate. Additionally, such a closure member should be capable of being safely and efficiently opened and closed such that the safety of the fishing operation is improved. It is, therefore, an object of the present invention to provide a C-plate assembly that meets these needs and eliminates the problems with prior art C-plates identified above. The ability of the improved C-plate assembly disclosed and claimed herein to meet these objectives will become apparent to those of skill in the art from a review of the specification below.

SUMMARY OF THE INVENTION

An improved C-plate assembly for use in a cable-guided fishing assembly is disclosed. The disclosed invention is a unique C-plate assembly in which a closure member is slidable from an open position, which allows a wellbore tubular or other item to be positioned in the cut-out section of the C-plate, to a closed position, which closes the opening to the cut-out section and thereby prevents the wellbore tubular or other item from being knocked out of the cut-out section during a fishing operation. The closure member is locked in place in the closed position by inserting the ends of a movable handle extending off of one side of the C-plate base into openings in the C-plate base. The ends of the movable handle are spring loaded to allow for the ends to be pulled out of the openings in the C-plate base such that the closure member can be "unlocked" and moved from a closed position to an open position during operation.

BRIEF DESCRIPTION OF THE DRAWINGS

The following figures form part of the present specification and are included to further demonstrate certain aspects of the present invention. The invention may be better understood by reference to one or more of these figures in combination with the detailed description of specific embodiments presented herein.

DESCRIPTION OF ILLUSTRATIVE EMBODIMENTS

The following examples are included to demonstrate preferred embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

Figure 3:
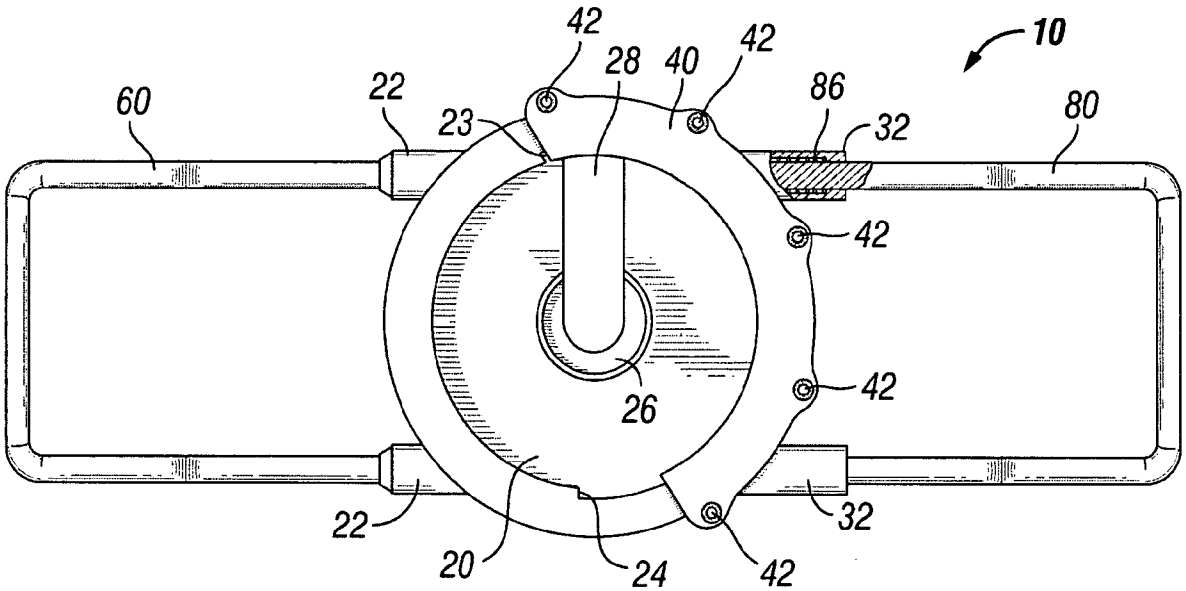
FIG. 3 is a top view of a C-plate assembly in accordance with the preferred embodiment of the present invention.
Figure 4:
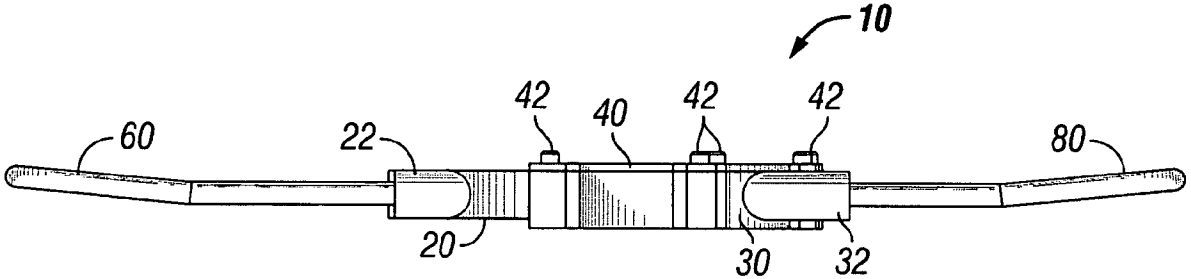
FIG. 4 is a side view of the C-plate assembly shown in FIG. 3.
Figure 5:
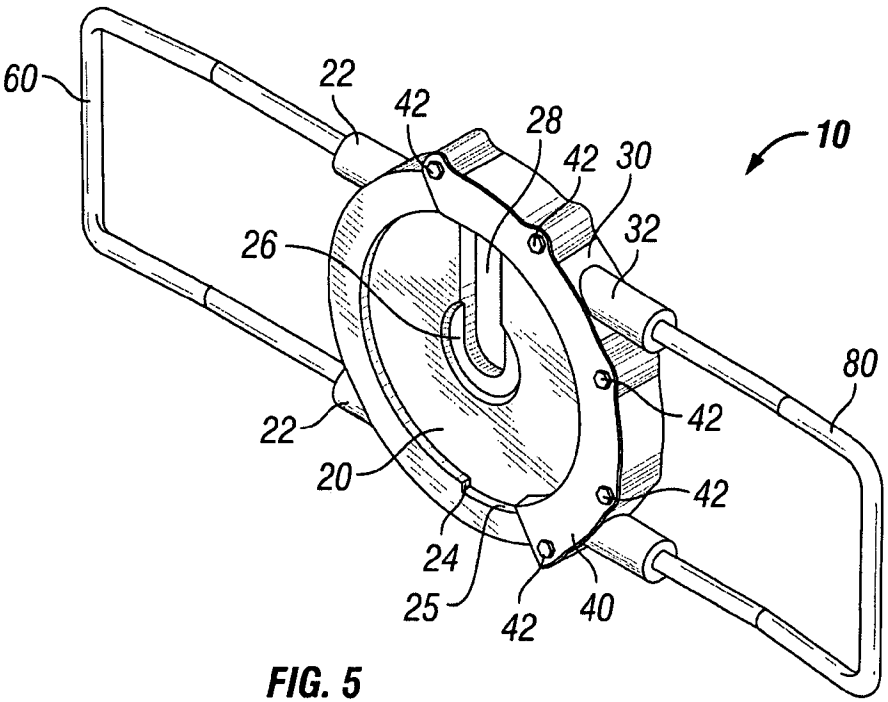
FIG. 5 is a three-dimensional view of the C-plate assembly shown in FIG. 3.

Referring to FIGS. 3 through 5, the C-plate assembly 10 of the present invention is shown in various views. In FIGS. 3 through 5, C-plate assembly 10 is shown with the closure member (comprising bottom section 30 and top plate 40) in the closed position such that the opening to the cut-out section 28 of C-plate base 20 is closed.

The components of C-plate assembly 10 include C-plate base 20, fixed handle 60, movable handle 80, and a closure member comprising bottom section 30 and top plate 40. As shown in FIGS. 3 through 5, bottom section 30 and top plate 40 are held together by a plurality of fasteners 42 that pass through openings 43 in top plate 40 (shown in FIG. 8) into attachment points 36 formed on bottom section 30 (shown in FIG. 7). Although not shown in FIG. 7, attachment points 36 are tapped and threaded to accept a threaded portion of fasteners 42 in the preferred embodiment. One of skill in the art will appreciate, however, that alternative means of attaching top plate 40 to bottom section 30 can be employed without departing from the objectives of the present invention. For example, alternative embodiments may utilize a plurality of bolts that pass all the way through attachment points 36 of bottom section 30 and are secured in place with nuts. Additionally, it is possible to attach top plate 40 to bottom section 30 by welding or any other suitable metal-to-metal connection technique.

Further, while the preferred embodiment of C-plate assembly 10 shown in FIGS. 3 through 5 uses a two-piece closure member (comprising bottom section 30 and top plate 40), one of skill in the art will appreciate that alternative embodiments of the present invention may use a one-piece closure member, or a permanently connected two-piece closure member (such as a hinged closure member), and still obtain the advantages of the present invention.

As shown in FIGS. 3 through 5, the ends of fixed handle 60 are inserted into and secured within extensions 22 that are integrally formed with (or attached to) C-plate base 20. Extensions 22 can be seen in more detail in FIG. 6. FIGS. 3 through 5 also show movable handle 80 connected to bottom section 30 of the closure member via extensions 32 that are integrally formed with (or attached to) bottom section 30. Extensions 32 can be seen in more detail in FIG. 7. FIG. 7 also shows openings 38 on the inside of bottom section 30 that allow the ends of movable handle 80 to pass into (and to be pulled out of) openings 84 in C-plate base 20 (as discussed below).

As can be seen in the cut-away portion of FIG. 3, extensions 32 are designed to house compression springs 86 about a portion of movable handle 80. The compression springs 86 are designed to maintain an inwardly directed force on movable handle 80 that forces a portion of the ends of movable handle 80 into openings 84 in the C-plate base 20 (shown in FIG. 6). When the ends of handle 80 are extended into openings 84 in C-plate base 20, the bottom section 30 (and thus top plate 40) is "locked" in the position shown in FIGS. 3 through 5 in which the opening to cut-out 28 is "closed." In this closed position, a wellbore tubular or other item placed within cut-out 28 cannot be slid outwardly (i.e., away from center notch 26) enough that it can come free from C-plate base 20.

Figure 1:
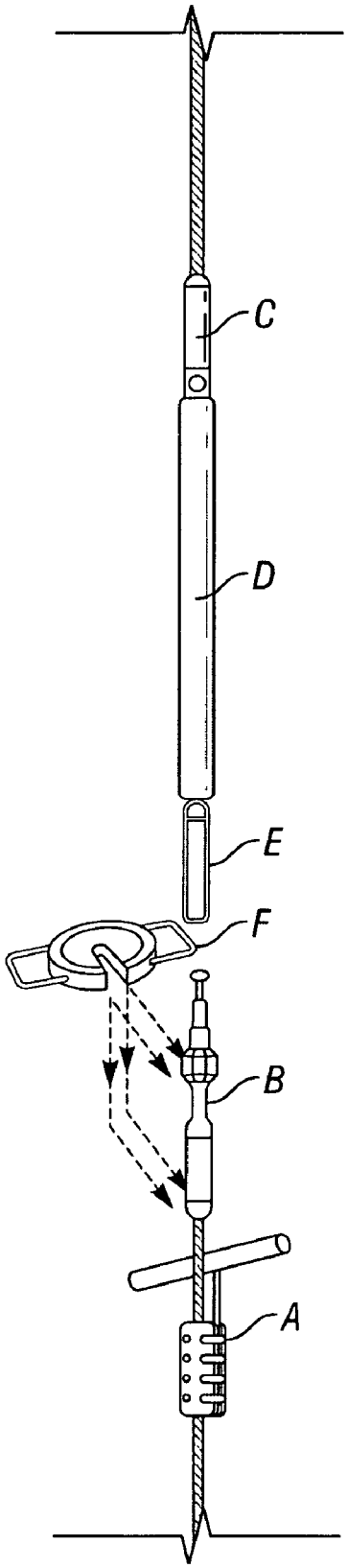
FIG. 1 is a side view of a typical cable-guided fishing assembly showing the various components of such assembly in their respective positions.
Figure 2:
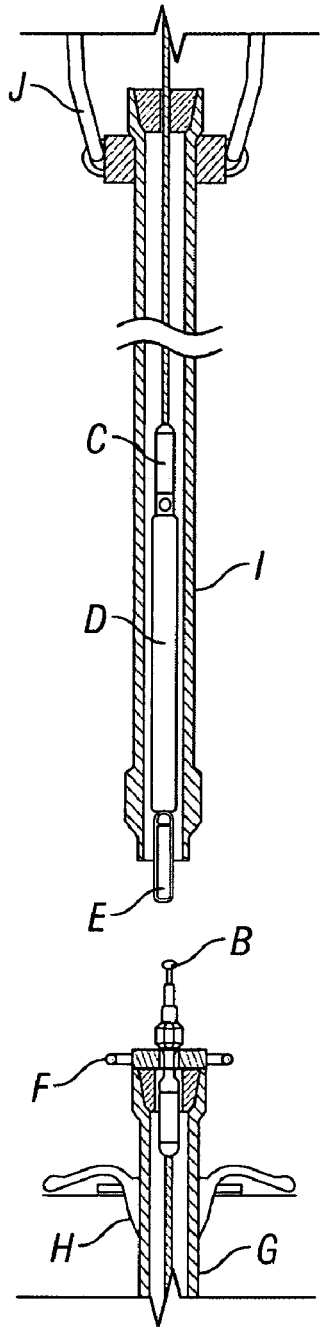
FIG. 2 is a side view of a typical cable-guided fishing assembly showing the various components of such assembly in their respective positions within tubular members during operation.

When it is necessary to remove C-plate assembly 10 during operation (as discussed above with respect to FIGS. 1 and 2), and thereby remove a wellbore tubular or other item from cut-out 28, a pulling force is exerted on movable handle 80 in a direction away from C-plate base 20. As this pulling force is exerted on movable handle 80, the compression springs 86 are compressed, thereby allowing movable handle 80 to move away from C-plate base 20 and retracting the ends of movable handle 80 out of openings 84 in C-plate base 20. With the ends of movable handle 80 pulled free from openings 84, movable handle 80 can be moved in a clockwise direction (i.e., to the left when looking down at C-plate base 20) such that bottom section 30 and top plate 40 "slide" in a clockwise direction about C-plate base 20. The movement of bottom section 30 and top plate 40, and thus the movement of movable handle 80, is ultimately stopped by the contact of bottom section 30 and top plate 40 with shoulder 24 on C-plate base 20. When such contact occurs, the bottom section 30 and top plate 40 (the closure member) has been moved a sufficient distance such that cut-out 28 is "open" and, thus, the C-Plate assembly 10 can be moved free from the wellbore tubular or other item within cut-out 28. The C-plate assembly 10 can then be set aside for future use.

Similarly, when C-plate assembly 10 is positioned for use, the closure member (i.e., bottom section 30 and top plate 40) is placed in the "open position" as discussed in the preceding paragraph. The C-plate assembly 10 is positioned by moving it such that a portion of a wellbore tubular or other item "slides" within the cut-out 28 until it rests within center notch 26. Movable handle 80 is then moved in a counterclockwise direction until bottom section 30 and top plate 40 come into contact with shoulder 23 on C-plate base 20. When such contact occurs, the ends of movable handle 80 are properly aligned with the openings 84 in C-plate base 20. Movable handle 80 is then released, and the compression springs 86 force the ends of movable handle 80 into openings 84, thereby locking the closure member in the "closed position." Although not shown in FIG. 3, compression springs 86 are retained in extensions 32 and exert an inwardly directed force on movable handle 80 via retainer rings attached to movable handle 80.

Figure 6:
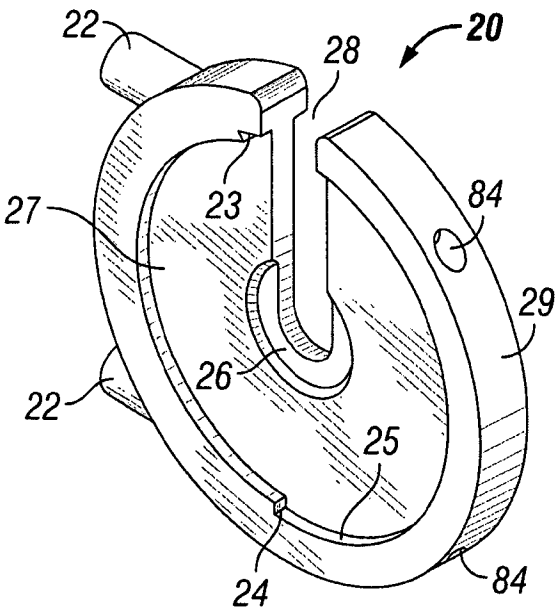
FIG. 6 is a three-dimensional view of the base of the C-plate assembly shown in FIG. 3.
Figure 7:
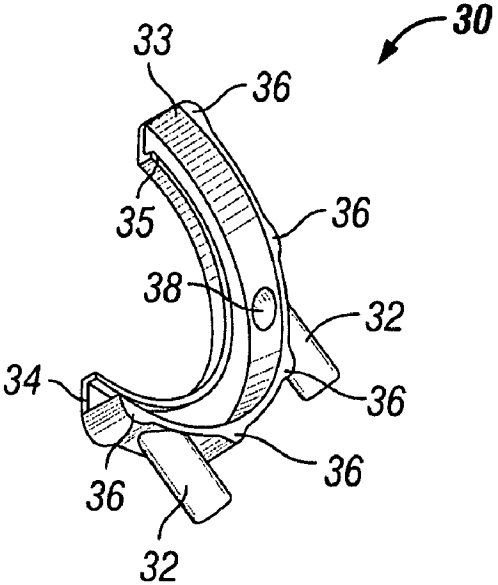
FIG. 7 is a three-dimensional view of the bottom section of the closure member of the C-plate assembly shown in FIG. 3.

Referring to FIGS. 6 through 8A, the mechanism whereby bottom section 30 and top plate 40 "slide" along C-plate base 20 is disclosed. As can be seen in FIG. 6, C-plate base 20 is formed with a recessed inner portion 27 on both sides of C-plate base 20. The recessed inner portions 27 on both sides of C-plate base 20 are bounded by vertical (or substantially vertical) walls 25.

As can be seen in FIG. 7, bottom section 30 includes a channel 34 that is bounded on its outer edge by wall 33 and on its inner edge by ridge 35. As shown, ridge 35 extends upwardly from the bottom of channel 34 a short distance. The curvature of bottom section 30 is designed to correspond to the curvature of the outer surface 29 of C-plate base 20 such that ridge 35 mates with the wall 25 on the underside of C-plate base 20 along the entire length of ridge 35. Ridge 35 is designed to be very close to, but not necessarily in contact with, wall 25 on the underside of C-plate base 20.

Figure 8A:
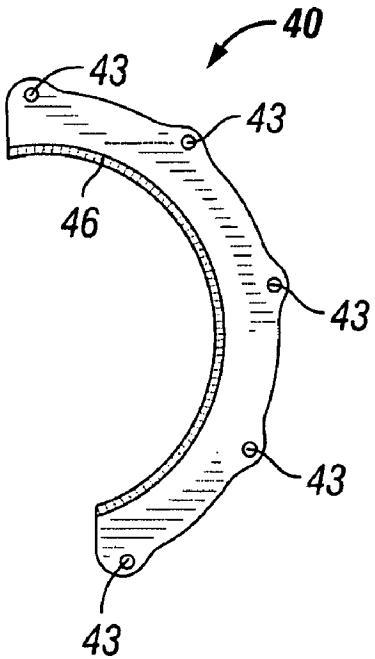
FIG. 8A is a two-dimensional view of the underside of the top section of the closure member shown in FIG. 8.
Figure 8:
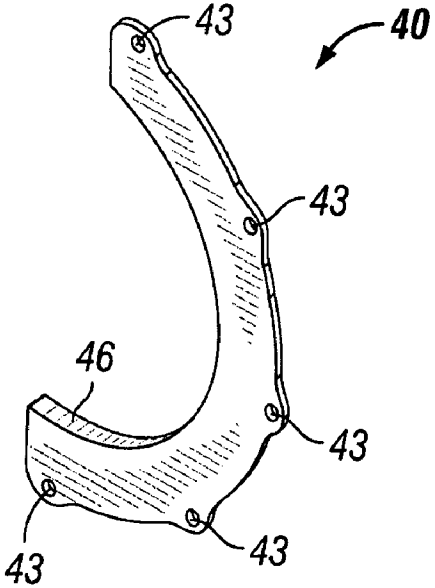
FIG. 8 is a three-dimensional view of the top section of the closure member of the C-plate assembly shown in FIG. 3.

Similarly, as can be seen in FIGS. 8 and 8A, top plate 40 includes ridge 46 along its inner edge. As shown, ridge 46 extends downwardly a short distance from the top surface of top plate 40. Like bottom section 30, the curvature of top plate 40 is designed to correspond to the curvature of the outer surface 29 of C-plate base 20 such that ridge 46 mates with the wall 25 on the top side of C-plate base 20 along the entire length of ridge 46. Ridge 46 is designed to be very close to, but not necessarily in contact with, wall 25 on the top side of C-plate base 20.

In this way, the combination of walls 25 on the under-side and top-side of C-plate base 20 and ridges 35 and 46 interact to hold the closure member in place about the outer surface 29 of C-plate base 20. Walls 25 essentially act as a "guide" surface for the bottom section 30 and the top plate 40 as they are "slid" from the C-plate closed position to the open position (and vice versa) by the movement of movable handle 80 (as discussed above).

Figure 9:
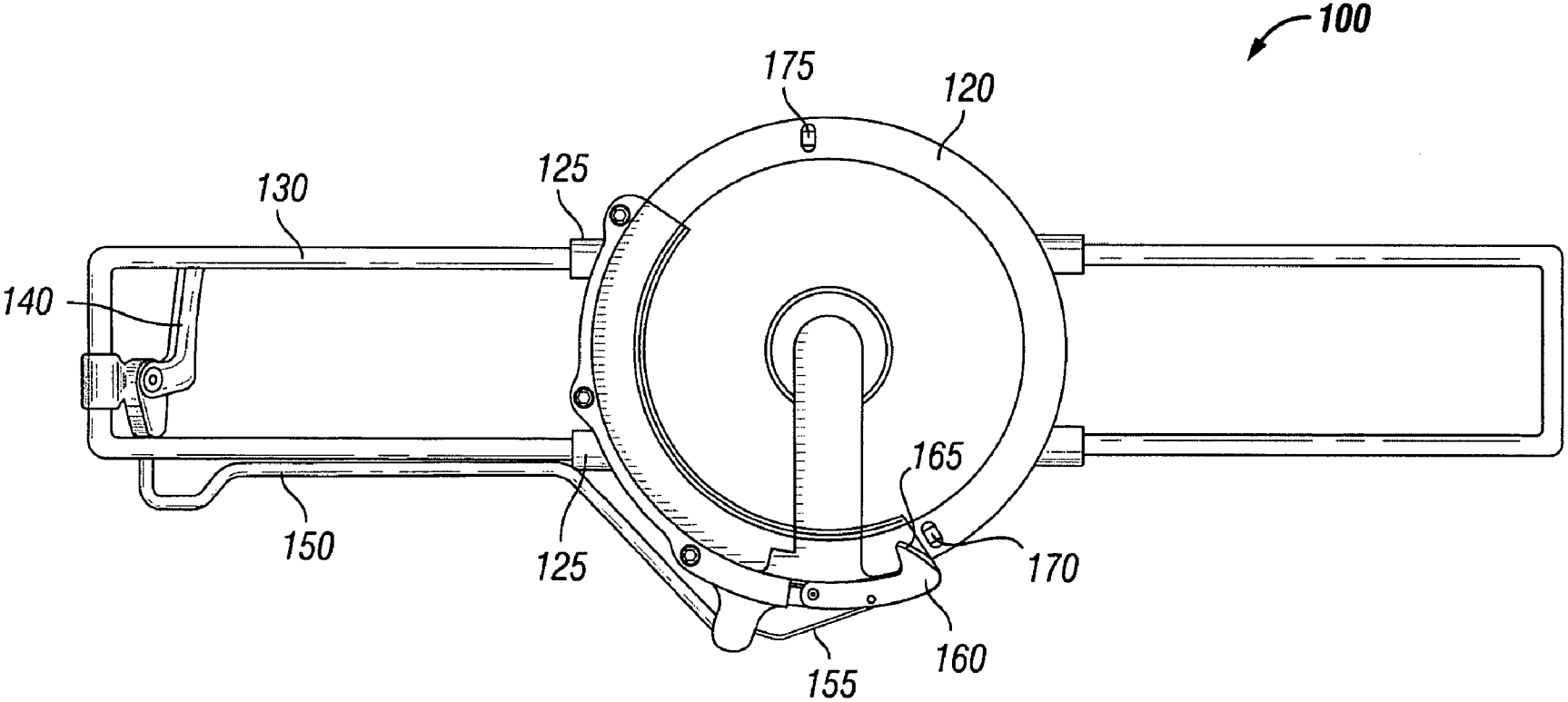
FIG. 9 is a top view of a C-plate assembly in accordance with an alternative embodiment of the present invention.

Referring to FIG. 9, an alternative embodiment of the present invention is shown. As shown in FIG. 9, the main components of the C-plate assembly 100 are substantially the same as the main components of the C-plate assembly 10 shown in FIGS. 3 through 5. In the alternative embodiment shown in FIG. 9, however, the ends of movable handle 130 do not pass into the bottom section of the closure member to "lock" the closure member in the closed position as discussed above. Rather, the ends of movable handle 130 are inserted into and secured in extensions 125 integrally formed with (or attached to) the bottom section of the closure member. To lock the closure member of C-plate assembly 100 in the closed position, the locking head 165 of a specially shaped locking member 160 is inserted into a notch cut into the outer surface of C-plate base 120.

To release the closure member from the locked position, locking member 160 is pivoted about its connection point to the closure member by an actuating mechanism comprising an actuator handle 140 and a cable 155 that functions in much the same way as a bicycle brake. That is, as the actuator handle 140 is pulled, the cable 155 is pulled, thereby pulling on locking member 160. The pulling force on locking member 160 causes it to pivot about its connection point to the closure member, resulting in the locking head 165 coming out of the notch cut into the outer surface of C-plate base 120. With locking head 165 removed from the notch in C-plate base 120, handle 130 can be moved clockwise such that the closure member "slides" from the closed position to the open position in the same way as described with respect to FIGS. 3 through 8A. The movement of the closure member about C-plate base 120 is limited by stops 170 and 175 integrally formed on (or attached to) C-plate base 120.

FIG. 9 also shows a length of conduit 150 running along movable handle 130. Conduit 150 serves to guide and protect cable 155 during use.

While the C-plate assembly of the present invention is designed for use as part of a cable-guided fishing assembly, one of skill in the art will appreciate that the C-plate assembly can be used on its own, i.e., without the remaining components of a typical cable-guided fishing assembly.

While the apparatus, compositions and methods of this invention have been described in terms of preferred or illustrative embodiments, it will be apparent to those of skill in the art that variations may be applied to the process described herein without departing from the concept and scope of the invention. All such similar substitutes and modifications apparent to those skilled in the art are deemed to be within the scope and concept of the invention as it is set out in the following claims.

The invention claimed is:

1. A C-plate apparatus comprising:

a base section having an opening that extends inwardly from an outer edge of the base section;

a closure member adapted for movement around the outer edge of the base section; and a plurality of handles, the plurality of handles including a movable handle that is movable in relation to the base section, wherein at least one of the plurality of handles is immovably secured to the base section; and a plurality of housings extending from the base section, the at least one of the plurality of handles immovably secured to the base section being secured within the plurality of housings.

2. The C-plate apparatus of claim 1 wherein each of the plurality of housings contain a compression spring that surrounds a portion of the movable handle.

3. The C-plate apparatus of claim 2 wherein the closure member comprises a bottom section and a top section.

4. The C-plate apparatus of claim 3 wherein the bottom section and the top section are connected together by a plurality of mechanical fasteners.

5. The C-plate apparatus of claim 4 wherein the plurality of fasteners comprise a plurality of threaded bolts.

6. The C-plate apparatus of claim 3 wherein the bottom section and the top section are connected together by welding.

7. The C-plate apparatus of claim 3 wherein the base section comprises a top side and a bottom side, each of the top side and the bottom side having a wall separating a recessed portion in the top side and a recessed portion in the bottom side from an outer portion of the base section.

8. The C-plate apparatus of claim 7 wherein the wall is a vertical wall.

9. The C-plate apparatus of claim 8 wherein the bottom section of the closure member comprises a wail forming the outer surface of the bottom section and a raised ridge along the interior edge of the bottom section.

10. The C-plate apparatus of claim 9 wherein the top section of the closure member comprises a ridge along the interior edge of the top section, the ridge extending downwardly from a top surface of the top section.

11. The C-plate apparatus of claim 10 wherein the raised ridge of the bottom section of the closure member, the ridge of the top section of the closure member, and the walls of the top side and bottom side of the base section function together to operatively connect the closure member with the base section.

12. The C-plate apparatus of claim 11 wherein the closure member is adapted for movement around the outer portion of the base section during use.

13. The C-plate apparatus of claim 12 wherein the raised ridge of the bottom section of the closure member, the ridge of the top section of the closure member, and the walls of the top side and bottom side of the base section function together to guide the movement of the closure member around the outer portion of the base section.

14. The C-plate apparatus of claim 13 wherein the movement of the closure member around the outer portion of the base section is limited by one or more shoulders on the outer portion of the base section.

15. The C-plate apparatus of claim 14 further comprising a plurality of holes in the wall that forms the outer surface of the bottom section.

16. The C-plate apparatus of claim 15 wherein the plurality of holes in the wall that forms the outer surface of the bottom section are adapted to receive ends of the movable handle.

17. The C-plate apparatus of claim 16 further comprising a plurality of holes in the outer portion of the base section, wherein the plurality of holes in the outer portion of the base section are adapted to receive the ends of the movable handle.

18. A C-plate apparatus comprising:

a base section having a top side and a bottom side, the top side and bottom side each having a wall separating a recessed portion in the top side and a recessed portion in the bottom side from an outer portion of the base section; a partlity of holes in the outer portion of the base section; and an opening that extends inwardly from an outer edge of the base section;

a fixed handle connected to the outer portion of the base section;

a movable handle that is movable in relation to the base section;

a closure member adapted for movement around the outer portion of the base section trough movement of the movable handle, the closure member having a bottom section and a top section, wherein the bottom section comprises a wall forming the outer surface of the bottom section and a raised ridge along the interior edge of the bottom section, and wherein the top section comprises a downwardly extending ridge along the interior edge of the top section;

a plurality of housings extending outwardly from the closure member, the plurality of housings operatively connecting the movable handle to the closure member and each containing a compression spring that surrounds a portion of the movable handle.

19. The C-plate apparatus of claim 18 wherein the bottom section and the top section of the closure member are connected together by a plurality of mechanical fasteners.

20. The C-plate apparatus of claim 19 wherein the plurality of mechanical fasteners comprise a plurality of threaded bolts.

21. The C-plate apparatus of claim 18 wherein the bottom section and the top section are connected together by welding.

22. The C-plate apparatus of claim 18 wherein the raised ridge of the bottom section of the closure member, the downwardly extending ridge of the top section of the closure member, and the walls of the top side and bottom side of the base section function together to operatively connect the closure member with the base section.

23. The C-plate apparatus of claim 22 wherein the raised ridge of the bottom section of the closure member, the ridge of the top section of the closure member, and the walls of the top side and bottom side of the base section function together to guide the movement of the closure member around the outer portion of the base section.

24. The C-plate apparatus of claim 23 wherein the movement of the closure member around the outer portion of the base section is limited by one or more shoulders on the outer portion of the base section.

25. The C-plate apparatus of claim 18 further comprising a plurality of holes in the wall that forms the outer surface of the bottom section of the closure member.

26. The C-plate apparatus of claim 25 wherein the plurality of holes in the wall that funs the outer surface of the bottom section of the closure member are adapted for receiving ends of the movable handle.

27. The C-plate apparatus of claim 26 wherein the plurality of holes in the outer portion of the base section are adapted for receiving the ends of the movable handle.

28. A method of securing a tubular within a C-plate apparatus, the method comprising:

providing a base section with an opening that extends inwardly from an outer edge of the base section and a plurality of holes in an outer portion of the base section;

providing a fixed handle connected to the base section;

providing a movable handle that is movable in relation to the base section, the movable handle comprising a plurality of ends;

providing a closure member adapted for movement round an outer portion of the base section through movement of the movable handle, the closure member having a bottom section and a top section, wherein the bottom section comprises a plurality of holes in an outer surface of the bottom section adapted to allow the plurality of ends of the movable handle to pass through the bottom section;

providing a plurality of housings extending outwardly from the closure member, the plurality of housings operatively connecting the movable handle to the closure member, and each of the plurality of housings containing a compression spring that surrounds a portion of the movable handle;

exerting a force on the movable handle such that the movable handle moves in a direction away from the base section, thereby compressing the compression springs and thereby moving the ends of the movable handle out of the plurality of holes in the outer portion of the base section;

moving the movable handle such that the closure member moves around the outer portion of the base section until the closure member no longer blocks the opening in the base section;

positioning the C-plate apparatus around a tubular such that the tubular resides within the opening in the base section;

moving the movable handle such that the closure member moves round the outer portion of the base section until the closure member blocks the opening in the base section;

releasing the force on the movable handle such that the compression springs force the movable handle inwardly toward the base section, thereby moving the ends of the movable handle into the plurality of holes in the outer portion of the base section.

29. The method of claim 28 further comprising connecting the bottom section and the top section of the closure member together by a plurality of mechanical fasteners.

30. The method of claim 29 wherein the plurality of mechanical fasteners comprise a plurality of threaded bolts.

31. The method of claim 28 further comprising connecting the bottom section and the top section of the closure member together by welding.

32. The method of claim 28 further comprising providing the base section with a top side and a bottom side each having a wall separating a recessed portion in the top side and bottom side from an outer portion of the base section.

33. The method of claim 32 wherein the bottom section of the closure member comprises a wail forming an outer surface of the bottom section and a raised ridge along the interior edge of the bottom section.

34. The method of claim 33 wherein the top section of the closure member comprises a downwardly extending ridge along the interior edge of the top section.

35. The method of claim 34 farther comprising operatively connecting the closure member and the base section together by the raised ridge of the bottom section of the closure member, the downwardly extending ridge of the top section of the closure member, and the walls of the top side and bottom side of the base section.

36. The method of claim 35 further comprising guiding the movement of the closure member around a portion of the base section by the raised ridge of the bottom section of the closure member, the ridge of the top section of the closure member, and the walls of the top side and bottom side of the base section.

37. The method of claim 36 further comprising forming one or more shoulders on the outer portion of the base section.

38. The method of claim 37 wherein the movement of the closure member around the outer portion of the base section is limited by the one or more shoulders.

39. A C-plate apparatus comprising:

a base section having a top side and a bottom side, the top side and bottom side each having a wall separating a recessed portion in the top side and a recessed portion in the bottom side from an outer portion of the base section; and an opening that extends inwardly from an outer edge of the base section;

a closure member adapted for movement around the outer portion of the base section, the closure member having a bottom section and a top section, wherein the bottom section comprises a wall forming the outer surface of the bottom section and a raised ridge along the interior edge of the bottom section, and wherein the top section comprises a downwardly extending ridge along the interior edge of the top section;

a fixed handle connected to the base section;

a movable handle connected to the closure member, the movable handle adapted for moving the closure member around the outer portion of the base section;

a locking mechanism for locking the closure member in a closed position, the locking mechanism comprising an actuator handle, a cable, and a locking member.

40. The C-plate apparatus of claim 39 wherein the base section further comprises a notch in the outer portion of the base section.

41. The C-plate apparatus of claim 40 wherein the locking member comprises a locking head, the locking head adapted for insertion into the notch in the outer portion of the base section when the closure member is in a closed position.

42. The C-plate apparatus of claim 41 wherein the locking mechanism further comprises conduit for housing the cable.

43. The C-plate apparatus of claim 42 wherein the bottom section and the top section of the closure member are connected together by a plurality of mechanical fasteners.

44. The C-plate apparatus of claim 43 wherein the plurality of mechanical fasteners comprise a plurality of threaded bolts.

45. The C-plate apparatus of claim 42 wherein the raised ridge of the bottom section of the closure member, the downwardly extending ridge of the top section of the closure member, and the walls of the top side and bottom side of the base section function together to operatively connect the closure member with the base section.

46. The C-plate apparatus of claim 45 wherein the raised ridge of the bottom section of the closure member, the ridge of the top section of the closure member, and the walls of the top side and bottom side of the base section function together to guide the movement of the closure member around the outer portion of the base section.

47. The C-plate apparatus of claim 46 wherein the movement of the closure member around the outer portion of the base section is limited by one or more shoulders on the outer portion of the base section.

48. The C-plate apparatus of claim 39 wherein the bottom section and the top section are connected together by welding.

* * * * *